United States Patent [19]

Allison et al.

[11] Patent Number: 4,509,226

[45] Date of Patent: Apr. 9, 1985

[54] UNITARY PAINT TRAY

[75] Inventors: Philip J. Allison, Renforth; Morley L. Smith, Beaconsfield, both of Canada

[73] Assignee: T. S. Simms & Co. Limited, Saint John, Canada

[21] Appl. No.: 594,217

[22] Filed: Mar. 28, 1984

[51] Int. Cl.[3] ..... B44D 3/12

[52] U.S. Cl. ..... 15/257.06

[58] Field of Search ..... 15/257.05, 257.06

[56] References Cited

U.S. PATENT DOCUMENTS

| | | | |
|---|---|---|---|
| D. 193,382 | 8/1962 | Goetz | 15/257.06 |
| 2,659,917 | 11/1953 | Drum | 15/257.06 |
| 4,297,762 | 11/1981 | Crysdale | 15/257.06 |

FOREIGN PATENT DOCUMENTS

| | | | |
|---|---|---|---|
| 2455015 | 5/1976 | Fed. Rep. of Germany | 15/257.06 |

*Primary Examiner*—Chris K. Moore

*Attorney, Agent, or Firm*—Fetherstonhaugh & Co.

[57] ABSTRACT

In a self-supporting paint tray, the improvement wherein the bottom wall is formed to provide a generally planner base for the tray extending inwardly from the side and end walls of the tray. The base comprises a generally, horizontally extending first support wall formed on the underside of the paint reservoir and a pair of L-shaped second support walls projecting from the first support wall, one along each side wall of the tray to the other end wall of the tray and a short distance laterally inwardly along the end wall of the tray. The ramp has side walls which extend downwardly to said second support walls in an oppositely disposed relationship with respect to said side walls and the ramp has an inner end wall communicating with said first support wall.

1 Claim, 10 Drawing Figures

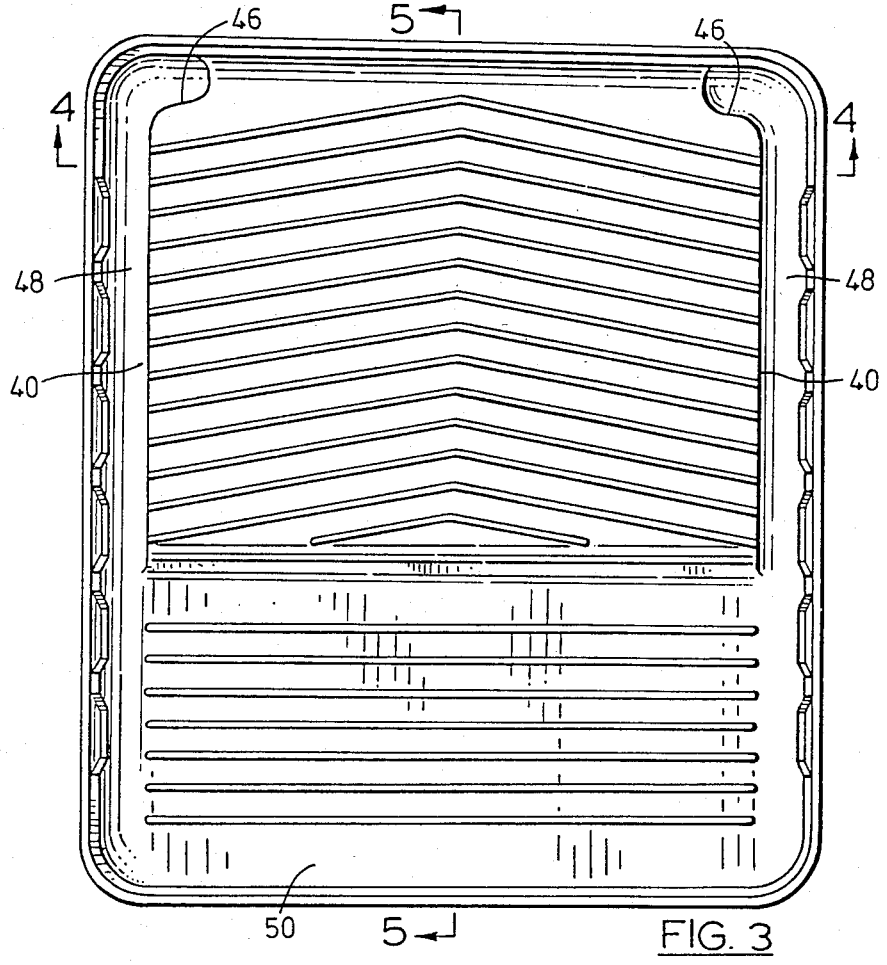
FIG. 3
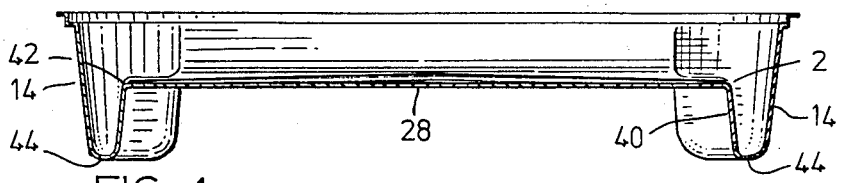
FIG. 4
FIG. 5
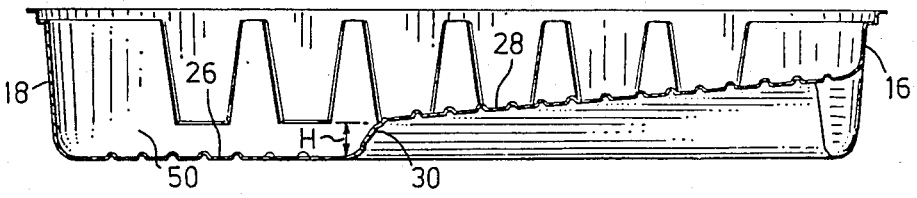

FIG. 8
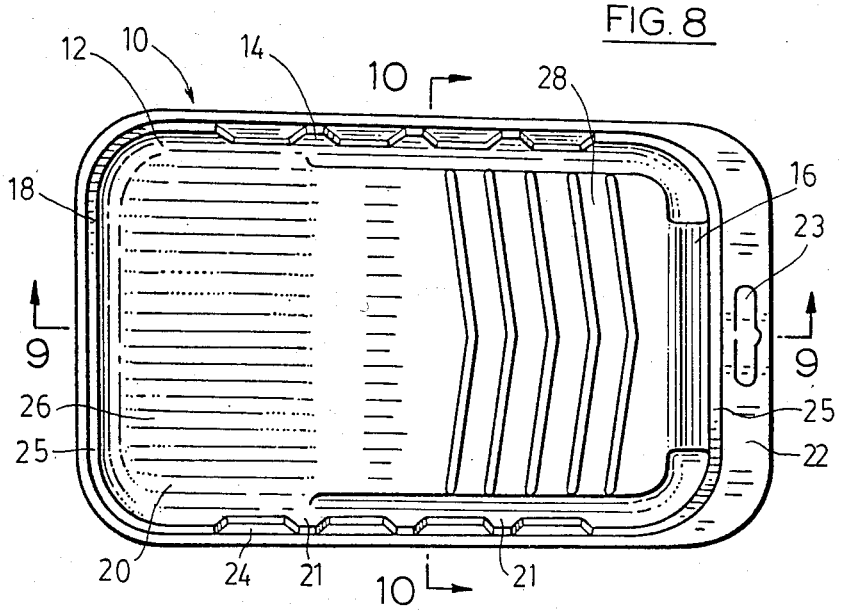
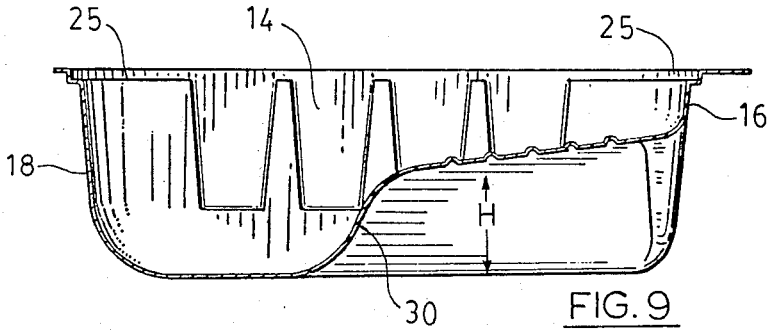
FIG. 9
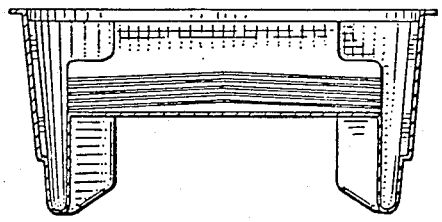
FIG. 10

UNITARY PAINT TRAY

FIELD OF INVENTION

This invention relates to paint trays. In particular, this invention relates to improvements in the construction of the base of a one-piece paint tray which provides strength and stability to the structure.

PRIOR ART

Difficulty has been experienced in providing roller coater paint trays which are inexpensive to manufacture and which are stable in use. Paint roller trays conventionally have a paint reservoir and an inclined ramp along which a roller is worked in order to remove excess paint and to evenly distribute paint on the roller. Difficulty has been experienced in developing a paint tray which can be formed from a unitary body and which is self-supporting and nestable. One of the problems which has been experienced is that of providing adequate structural support for the ramp so that the tray will not buckle when subjected to the loads applied to the ramp by the paint roller in use.

These difficulties have been overcome by the structure of the present invention which provides a simple and inexpensive paint tray which can be formed from a unitary body of material such as plastic or sheet metal.

SUMMARY OF INVENTION

According to one aspect of the present invention, there is provided in a paint tray, comprising a unitary body having a bottom wall, a pair of oppositely disposed side walls and a pair of oppositely disposed end walls, the bottom wall being formed to provide a raised ramp which extends inwardly and downwardly from a first end wall and a paint reservoir which extends inwardly from a second end wall, the improvement wherein the bottom wall is formed to provide a generally planner base for the tray extending inwardly from the side and end walls of the tray comprising a generally, horizontally extending first support wall formed on the underside of the paint reservoir and a pair of L-shaped second support walls projecting from said first support wall, one along each side wall of the tray to said first end wall and a short distance laterally inwardly along said first end wall, said ramp having side walls which extend downwardly to said second support walls in an oppositely disposed relationship with respect to said side walls, said ramp having an inner end wall communicating with said first support wall.

PREFERRED EMBODIMENT

The invention will be more clearly understood after reference to the following detailed specification read in conjunction with the drawings wherein:

FIG. 3 is a plan view of the paint tray of FIG. 1.

FIG. 4 is a sectional view of the paint tray of FIG. 3 taken along the line 4—4.

FIG. 5 is a sectional view of the paint tray of FIG. 3 taken along the line 5—5.

FIG. 8 is a plan view of the paint tray of FIG. 6.

FIG. 9 is a sectional view taken along the line 9—9 of FIG. 8.

FIG. 10 is a sectional view taken along the line 10—10 of FIG. 8.

Figure 1:
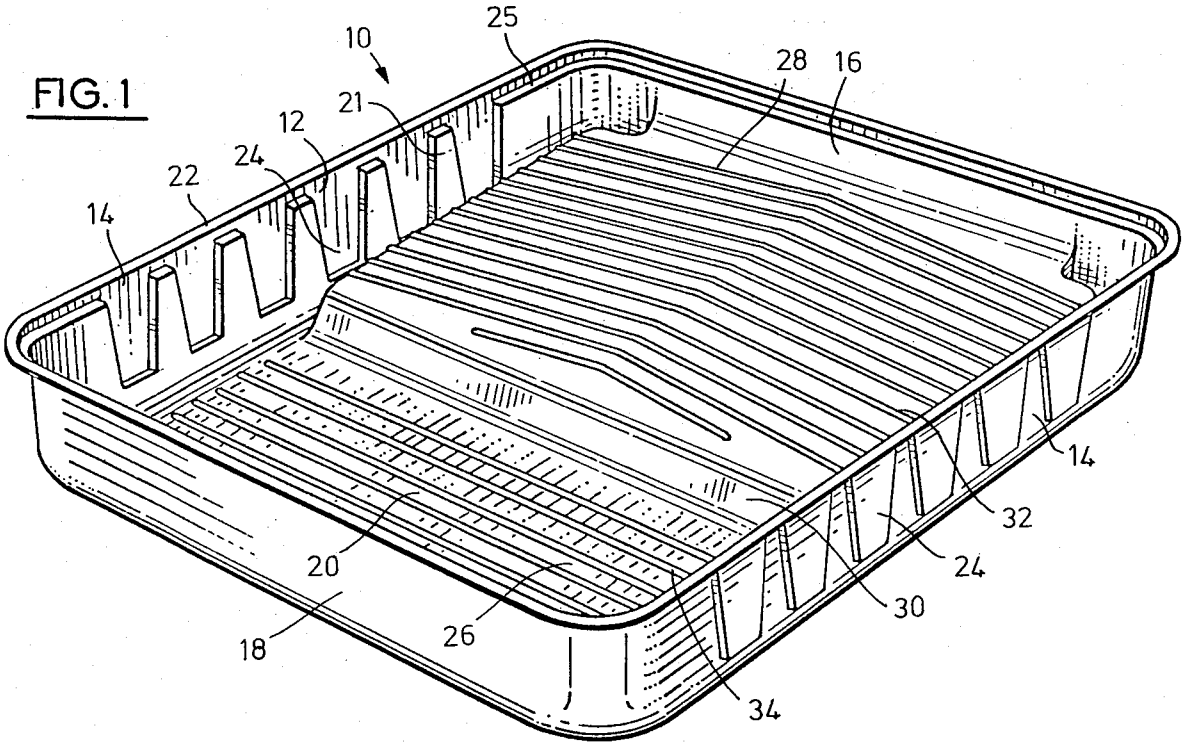
FIG. 1 is a pictorial plan view of a paint tray constructed in accordance with the embodiments of the present invention.
Figure 2:
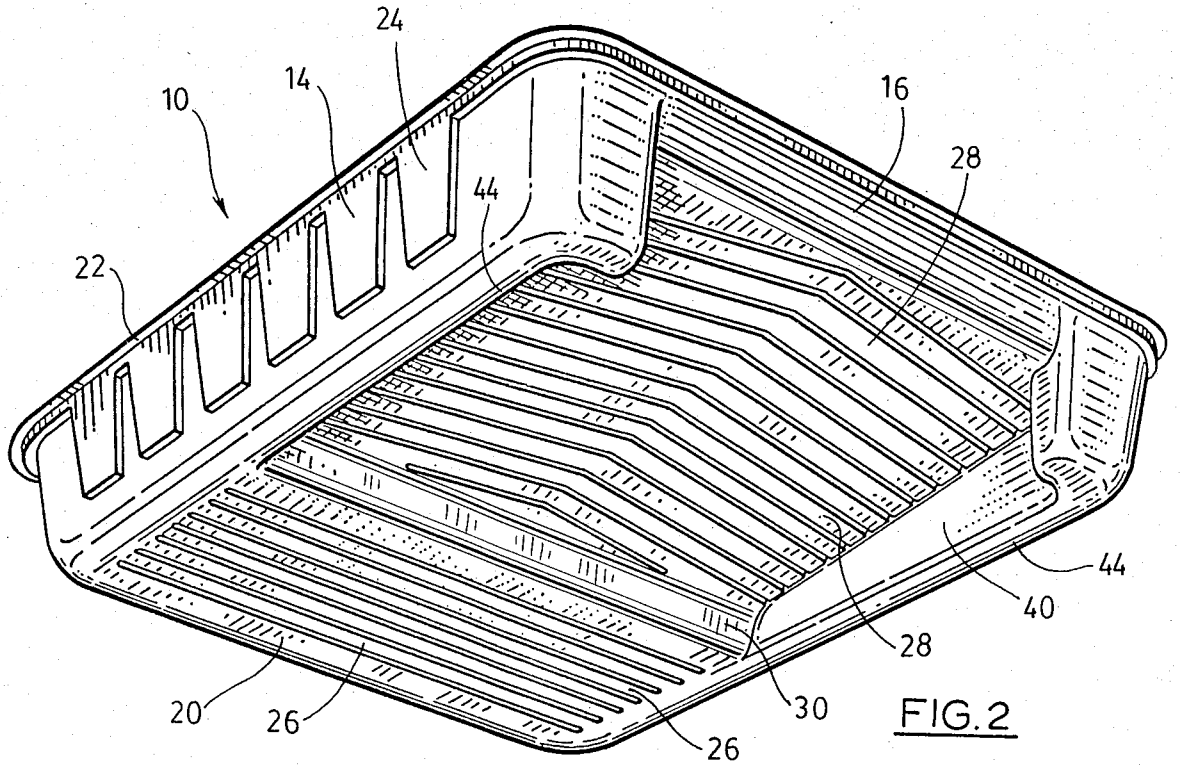
FIG. 2 is a pictorial view of the underside of the paint tray of FIG. 1.
Figure 6:
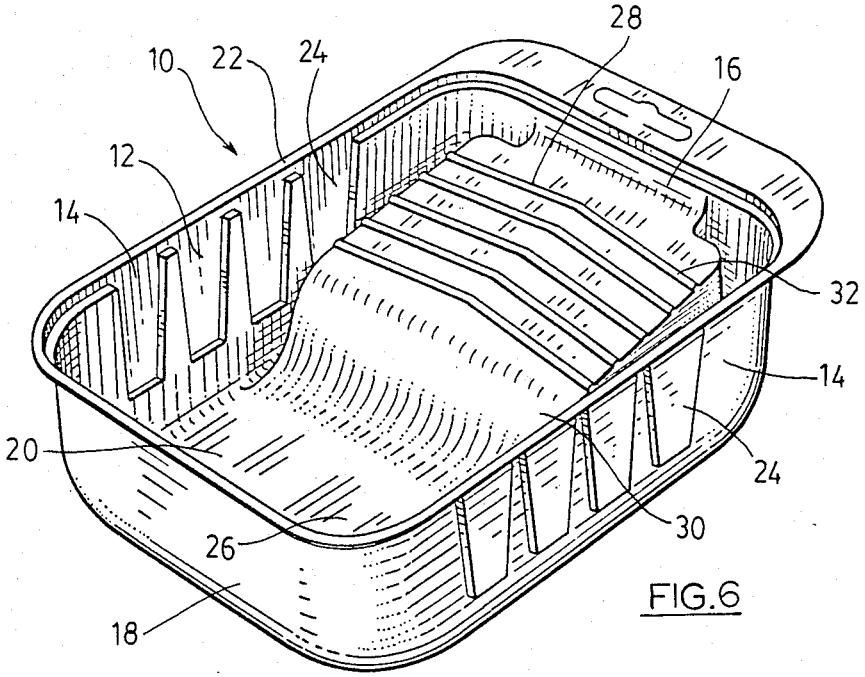
FIG. 6 is a pictorial top view of a paint tray constructed in accordance with a further embodiment of the present invention.
Figure 7:
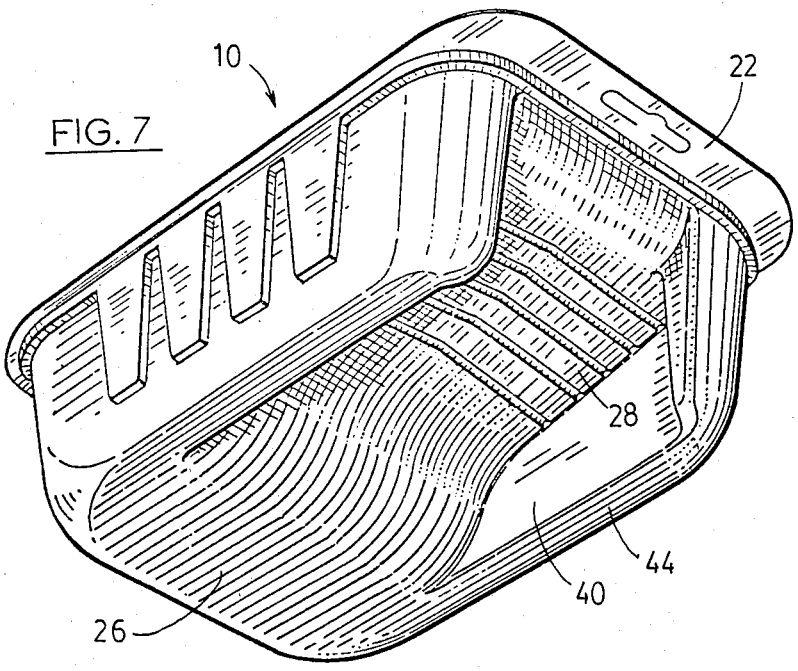
FIG. 7 is a pictorial bottom view of the paint tray of FIG. 6.

With reference to FIG. 1 of the drawings, the reference numeral 10 refers generally to a paint tray constructed in accordance with an embodiment of the present invention. The paint tray 10 consists of a unitary body 12 which is preferably made from a sheet of plastics material by a vacuum forming process. The body 12 may, however, be made from sheet metal and it may be formed by methods other than a vacuum forming method.

The body 12 is formed to provide a pair of oppositely disposed side walls 14, a first end wall 16, a second end wall 18 and a bottom wall 20. A narrow flange 22 projects laterally outwardly from the upper edge of the side walls 14 and end walls 16 and 18. A reinforcing pattern of ribs 24 are formed on the side walls 14.

The bottom wall 20 is formed with a generally flat portion 26 which extends inwardly from the end wall 18 and a ramp 28 which is connected to the flat portion 26 by a sharply upwardly and rearwardly inclined section 30. The ramp 28 is downwardly inclined from its connection with the end wall 16 to its connection with the portion 30. A plurality of ridges 32 are arranged in a chevron pattern on the upper face of the ramp 28. Similar ridges 34 are formed on the inner face of the flat portion 26. These ridges serve to facilitate the distribution of paint across the full width of the roller in use.

The ramp 28 has side walls 40 (FIG. 4) which extend downwardly from the side edges 42 in a spaced relationship with respect to the side walls 14 of the tray and are connected to the side walls 14 by a transverse portion 44. The side walls 40 of the ramp 28 follow a generally L-shaped path as shown in FIG. 3 and include short laterally extending portions 46. The transverse bottom wall portions 44 follow the same L-shaped configuration. A narrow channel 48 is formed between the side walls 40, 46 of the ramp and the side walls 14 of the tray. These channels 48 communicate with the main reservoir 50 which is formed above the wall portion 26 and serve to enlarge the paint storage capacity of the tray. The side walls 14 of the tray and side walls 40 of the ramp 28 together with the bottom wall portions 44, serve to form support legs which extend longitudinally of the tray on each side of the ramp 28 and include short transversely extending portions which extend inwardly from opposite sides of the tray at the end wall 16. These legs together with the underside of the wall portion 26 of the reservoir form a stable base for the tray which permits the tray to function as a self-supporting paint tray.

To ensure a large capacity reservoir, the inclined surface of the ramp 28 terminates at a distance H (FIG. 5) above the bottom wall 26. Generally, in prior paint tray designs, the ramp extends continuously to the horizontal bottom wall of the reservoir. This structure has the disadvantage that the lower portion of the ramp is generally submerged in the paint and is not therefore useful for the primary purpose of the ramp, namely the spreading of the paint across the roller. By providing a steeply inclined wall portion 30 at the end of the ramp 28, I clearly define the portion of the ramp which will normally remain above the level of paint in the reservoir, while also maximizing the capacity of the reservoir 50. Preferably, the height H is equal to about 25% of the height of the side walls in a tray constructed for use with a conventional 240 mm paint tray. In smaller trays, such as those constructed for use in association with trim roller coaters, the height H may be about 50% of the overall height of the side walls as is shown for example in the embodiments illustrated in FIG. 9 of the drawings.

FIGS. 6 to 10 of the drawings illustrate a paint tray which differs in proportion to the paint tray illustrated in FIGS. 1 to 5 of the drawings. This paint tray is intended for use with narrow paint rollers of the type to be used for painting trim or in confined spaces. As indicated above, the principal difference between the paint tray of this embodiment and the paint tray illustrated in FIGS. 1 to 5, is that in order to achieve an adequate reservoir storage capacity for paint, the wall portion 30 is steeply inclined and extends to a height H which is about 50% of the total height of the side walls 14. In addition, the flange portion 22 is enlarged at one end and has a knock-out panel 23 which may be removed to provide a hanger slot. In addition, a closure panel may be located in the recess 25 which extends about the upper edge of each end wall and across the upper ends of the reinforcing ribs 21.

A typical tray constructed in accordance with the embodiments illustrated in FIGS. 1 to 4 of the drawings, may have an overall width of $11\frac{1}{2}''$, an overall length of $13\frac{7}{8}''$ and an overall depth of $2\frac{1}{4}''$. The width of the ramp may be about $9\frac{1}{2}''$ and the distance between the inner ends of the L-shaped portions at the end wall 16 may measure $7\frac{3}{4}''$. The edge of the ramp at the end walls 16 may be 1" below the upper edge of the tray and the overall length of the ramp may be $7\frac{1}{2}''$ with the angle of inclination of the ramp with respect to the horizontal plane, being about 5 degrees. The ridges 32 are spaced a $\frac{1}{2}''$ apart on the ramp. The bottom wall 26 of the reservoir 50 has a length of about $4\frac{1}{2}''$. For the purposes of nesting, the side walls are formed with a draft angle of about 5 degrees.

In a typical paint tray constructed in accordance with the embodiment illustrated in FIGS. 6 to 10 of the drawings, may have an overall width of $5\frac{1}{4}''$, an overall length of 8" and an overall depth of $2\frac{1}{2}''$. The width of the ramp may be about 4" and the distance between the inner ends of the L-shaped portions at the end wall 16 may measure $2\frac{3}{4}''$. The edge of the ramp at the end walls 16 may be $\frac{3}{4}''$ below the upper edge of the tray and the overall length of inclined portion of the ramp may be about 3" with the angle of inclination of the ramp with respect to the horizontal plane, being about 7 degrees add the ridges 32 are spaced a $\frac{1}{2}''$ apart. The flat portion of bottom wall 26 of the reservoir 50 has a length of about $1\frac{1}{2}''$. For the purposes of vacuum forming and nesting of the trays during shipping and storage, the side walls are formed with a draft angle of about 5 degrees.

A suitable plastic material for use in manufacturing the paint trays by means of a vacuum forming process is a high density polystyrene, a high density polyethelene, PVC or the like.

From the foregoing, it will be apparent that the paint tray of the present invention has a stable load supporting construction which is obtained through a simple and inexpensive formation of the unitary body from which the tray is manufactured.

The embodiments of the invention in which an exclusive property or privilege is claimed are defined as follows:

1. A nestable paint tray comprising a unitary body having a bottom wall, and a pair of oppositely disposed side walls and a pair of oppositely disposed end walls, said side and end walls having an upper edge extending in a first plane, the bottom wall being formed to provide a raised ramp which extends inwardly and downwardly from a first end wall and a paint reservoir which extends inwardly from a second end wall, said bottom wall being formed to provide a generally planar base for the tray extending inwardly from the side walls, and, said first and second end walls of the tray terminating in a second horizontal plane, said side walls extending from said first plane to said second horizontal plane along the full length thereof, said planar base comprising a generally horizontally extending first support wall formed on the underside of the paint reservoir and a pair of L-shaped second support walls projecting from said first support wall, one along the full length of each side wall of the tray to said first end wall and a short distance laterally inwardly along said first end wall, said ramp having side walls which extend downwardly to said second support walls in an oppositely disposed spaced relationship with respect to said side walls, said ramp having an inner end wall communicating with said first support wall, said side and end walls of said tray and side walls of said ramp being arranged to define an upwardly open enclosure which will accommodate a further tray of like construction in a nesting relationship.

* * * * *